US006531007B1

(12) United States Patent
Nilsson et al.

(10) Patent No.: US 6,531,007 B1
(45) Date of Patent: Mar. 11, 2003

(54) METHOD FOR THE MANUFACTURE OF STEEL PRODUCTS OF A PRECIPITATION HARDENED MARTENSITIC STEEL, STEEL PRODUCTS OBTAINED WITH SUCH METHOD AND USE OF SAID STEEL PRODUCTS

(75) Inventors: Jan-Olof Nilsson, Sandviken (SE); Sören Olsson, Sandviken (SE); Hubert Sjoerd Blaauw, Drachten (NL); Adriaan Van der Grijn, Drachten (NL)

(73) Assignees: Sandvik AB, Sandviken (SE); Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 09/644,079

(22) Filed: Aug. 23, 2000

(30) Foreign Application Priority Data

Aug. 23, 1999 (SE) ..... 9902977

(51) Int. Cl.[7] ..... C21D 6/02
(52) U.S. Cl. ..... 148/658; 148/663; 148/578
(58) Field of Search ..... 148/658, 663, 148/578

(56) References Cited

FOREIGN PATENT DOCUMENTS

JP 62180040 * 8/1987
JP 62-180040 8/1987
WO 93/07303 4/1993

OTHER PUBLICATIONS

Holmquist, M., Nilsson, J.–O., and Stigenberg, A. Hultin, Isothermal Formation of Martensite in a 12Cr–9Ni–4Mo Maraging Stainless Steel, Scripta Metallurgica et Materialia, vol. 33, No. 9, pp. 1367–1373, 1995.
Zhuravlev, L.G.; Shteinberg, M.M.; Petsakhov, Yu. B., Stabilization of austerite in alloys with Isothermal and a thermal kinetics of martensitic transformation, IZV. Vyssh. Uchebn. Zaved, Chem. Metall. (1976), (4), 138–40 (abstract only).*
U.S. Patent Application No. 09/713,021, Anna Lena Nyström et al, Nov. 16, 2000.

* cited by examiner

*Primary Examiner*—Sikyin Ip
(74) *Attorney, Agent, or Firm*—Burns, Doane, Swecker & Mathis, L.L.P.

(57) ABSTRACT

A method for the manufacture of steel products and products thus produced, wherein steel is subjected to precipitation hardening in a martensitic structure subsequent to soft annealing and thereafter shaping. The method steps include shaping followed by solution annealing between 1200° C. and 1050° C., quenching from the solution annealing temperature with a quenching speed of at least 5° C. per second to a temperature below 500° C., subjecting said steel to an isothermal martensitic transformation and subsequently hardening the steel at a temperature between 450° C. and 550° C. to precipitate particles out from solution into said martensitic structure.

5 Claims, 1 Drawing Sheet

Figure 1:
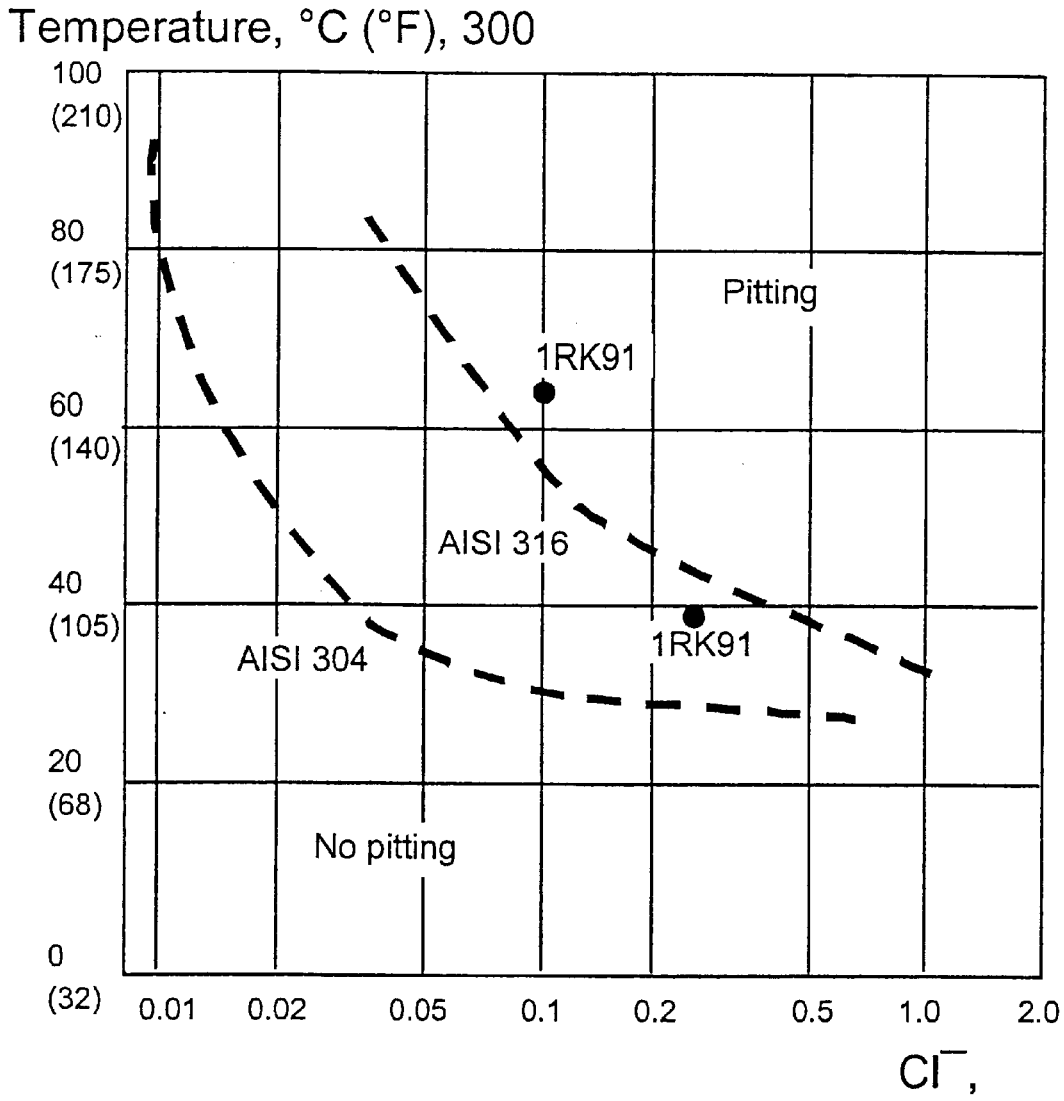

METHOD FOR THE MANUFACTURE OF STEEL PRODUCTS OF A PRECIPITATION HARDENED MARTENSITIC STEEL, STEEL PRODUCTS OBTAINED WITH SUCH METHOD AND USE OF SAID STEEL PRODUCTS

BACKGROUND OF THE INVENTION

1. Field of the Invention

The present invention relates to a method for the manufacture of a steel product wherein the steel is subjected to isothermal martensite formation and precipitation hardening in a martensitic structure subsequent to soft annealing and shaping. The invention also relates to a steel product obtained with such method and to the use of said steel product.

2. State of the Art

In the discussion of the state of the art that follows, reference is made to certain structures and/or methods. However, the following references should not necessarily be construed as an admission that these structures and/or methods constitute prior art. Applicant expressly reserves the right to demonstrate that such structures and/or methods do not qualify as prior art against the present invention.

In published international patent application WO93/07303, a method of manufacture of the above mentioned kind has been described wherein the transformation into the martensitic structure is accomplished by air cooling after annealing in the austenitic region or by cold working. Air cooling after annealing normally results in the so-called athermal kinetic mode of martensite transformation. The formation of air cooling induced martensite is suppressed by alloying elements like nickel, titanium and aluminum, which are used for precipitation of hardenable steel. It may be that at relatively high concentrations of such alloying elements the austenite is stabilized such that the martensitic transformation start temperature becomes impracticably low.

SUMMARY OF THE INVENTION

It is an object of the invention to offer a method for the manufacture of steel products, steel products so manufactured and the use of said steel products whereby a practical optimum is achieved between ductility, strength, wear and corrosion resistance, homogeneity of martensite distribution and a practical level of the martensite transformation temperature.

One aspect of the present invention is a method for the manufacture of a steel product comprising the steps of subjecting the steel to precipitation hardening in a martensitic structure subsequent to soft annealing. The steel is then shaped into the desired form followed by solution annealing between a temperature of 1200° C. and 1050° C. and for a time period of from 5 to 30 minutes. From the annealing temperature, the steel is quenched at a rate of at least 5° C. per second to a temperature below 500° C. The quenched steel being subjected to an isothermal martensitic transformation. Hardening of the steel is then accomplished at a temperature of between 450° C. and 550° C. for at least 3 minutes to cause precipitation of particles out of solution into the martensitic structure.

BRIEF DESCRIPTION OF THE DRAWING FIGURE

The objects and advantages of the invention will become apparent from the following detailed description of preferred embodiments thereof in connection with the accompanying drawing.

FIG. 1 is a temperature profile in time of the heat treatment and processing method of the present invention.

DETAILED DESCRIPTION OF PREFERRED EMBODIMENTS

A method for the manufacture of a steel product according to the invention is characterized by shaping of the steel followed by solution annealing between 1200° C. and 1050° C. for from 5 to 30 minutes, after which the steel is quenched from the solution annealing temperature to a temperature below 500° C. with a quenching speed of at least 5° C. per second. The quenched steel is then subjected to an isothermal martensitic transformation and is subsequently hardened by being held at a temperature between 450° C. and 550° C. for at least 3 minutes to precipitate out particles from solution into the martensitic structure.

A combination of an isothermal martensitic transformation and precipitation hardening is known (See Scripta Metallurgica et Materialia, 1995, Vol. 33, No. 9, pp. 1367–1373). However, a method of manufacture of the above-mentioned kind which allows a steel product to be formed of a relatively complicated shape by deformation whilst achieving an optimum between ductility, strength, wear and corrosion resistance and homogeneity of martensite distribution is not disclosed.

It is a further object of the invention to provide a very efficient method for the manufacture of steel products with a homogeneous distribution of martensite and precipitates.

Accordingly, a method for the manufacture of steel products according to the invention is further characterized by subjecting the quenched steel to an isothermal martensitic transformation by holding the steel at a temperature between −30° C. and −50° C. for at least one hour.

A method for the manufacture of steel products according to the invention is still further characterized by a sensitizing procedure in which the steel is held at a temperature between 950° C. and 850° C. for at least 5 minutes so as to allow initiation of the martensitic transformation to become optimal. The sensitizing procedure occurs between solution annealing and quenching the steel. A steel subjected to a sensitizing procedure avoids thermo-mechanical stresses which would otherwise build up internally in the steel product. The absence of internal thermo-mechanical stresses enables the manufacture of a steel product with a very accurate size and which is stable in use.

A further object of the invention is to provide a method of manufacture of a steel product exhibiting a combination of superior strength, corrosion resistance and ductility. Such a method is further characterized in that the steel comprises chromium (Cr) in a weight percentage between 10% and 14%. Generally, martensitic steels with a low weight percentage of carbon, so-called maraging steels, may be with or without chromium. Corrosion resistant maraging steels comprise a weight percentage of chromium between 10.5 and 18%. A particular type of maraging steel, which may be obtained by the method according to the invention, contains in weight percentage 10–14% Cr, 7–10% Ni, 5–6% Mo, 0–9% Co, 0.5–4% Cu, 0.05–0.5% Al, 0.4–1.4% Ti and less than 0.03% C and N.

The invention will be elucidated further by the use of practical examples:

EXAMPLE 1

A steel material suitable for use with the present invention and containing a weight percentage of Cr of 10–14% was produced as a strip material from a full scale seven ton melt in a high frequency furnace and then subjected to rolling. The solidification process after melting 1 is shown in FIG. 1 in which the temperature profile over time is indicated by a solid line. Solidification of the melt leads to crystallization of Ti (C, N), thereby binding the free carbon and free nitrogen. The binding of free nitrogen is important because the free nitrogen would otherwise prohibit the isothermal martensitic transformation.

Before rolling, the steel is reheated to a temperature of 1150–1250° C. and soaked at this temperature for at least 1 hour in order to give the material an austenitic structure and sufficient ductility to be hot rolled. Reheating to a temperature of 1150–1250° C. 2 is followed by hot rolling 3. Hot rolling 3 produces a material in a strip shape with a suitable grain size and evenly distributed intermetallic inclusions of carbon. Additionally, hot rolling into a strip is accomplished without resulting in a strain induced martensitic transformation.

Scale (oxide layers) formed during soaking and hot rolling has to be removed by etching and/or grinding before the material can be cold rolled to final dimensions. Cold rolling 4 gives the strip steel the final thickness without formation of oxide layers. Cold rolling 4, however, leads to strain induced martensitic transformations and, to ensure sufficient ductility to form a complicated product, the material has to be brought back into the austenitic condition by annealing 5. This annealing 5 is carried out in a continuous furnace at a temperature around 1050° C., to prevent the material from transforming to martensite before shaping of the product. The product is cold formed in the austenitic condition 6 leading to a partial transformation to strain induced martensite. To ensure a homogeneous martensite transformation throughout the product and sufficient hardenability of the formed martensite by precipitation hardening, the material has to be solution annealed 7 for 5 to 30 minutes at a temperature between 1050° C. and 1200° C. Solution annealing 7 also causes Al, Mo, Cu, Ti, C and N to go into substitutional and/or interstitial solution in the austenitic structure and reversion of strain induced martensite to austenite. The elements Al, Cu, Mo and Ti in solution are used for precipitation hardening of the isothermal martensite in a later stage of the manufacture.

In order to achieve an optimal isothermal martensitic transformation 10, the martensitic transformation 10 should be carried out at a temperature between −30° C. and −50° C. for at least one hour. More preferably, the isothermal martensitic transformation 10 is preceded by a sensitizing process 8. The sensitizing process 8 is positioned between a solution annealing step 7 and a quenching step 9. The sensitizing process 8 occurs when the steel is held at a temperature between 850° C. and 950° C. for at least five minutes. The sensitizing process 8 causes destabilization of the austenitic structure of the steel material and so facilitates the later isothermal martensitic transformation 10. It has been determined that during the sensitizing process 8, Mo and Ti are removed from the solution and it is believed that Mo concentrates along crystal boundaries. The behavior of Ti is not yet clear. Sensitization further ensures homogeneous nucleation of martensite during the isothermal martensitic transformation 10. Quenching 9 to room temperature or even lower prevents premature precipitation of essential intermetallic compounds in the austenite.

After quenching 9, the steel material is subjected to an isothermal martensitic transformation 10. This transformation is accomplished by holding the steel at a temperature of −30° C. to −50° C. for at least one hour. The result is a homogeneous martensitic structure with regularly distributed retained austenite in a fine grain size. The isothermal martensitic transformation 10 is followed by a hardening procedure 11 during which intermetallic compounds like $\eta$-$Ni_3$(Al, Mo, Ti) and $\beta$-NiAl precipitate out from substitutional and/or interstitial solution into the martensitic structure. The steel product so treated will have a homogeneous hardness of more than 500 HV.

A steel product which is obtained by the present method exhibits excellent properties with respect to wear and corrosion resistance, homogeneous hardness and ductility during the austenitic phase of the manufacture. This makes the strip steel product very attractive for shaver caps of electric rotary shavers, which are subjected to deep drawing during manufacture in order to obtain the necessary bowl shape. The same applies to the heavily deformed cutters of shavers, the strongly shaped knives of blenders and the strongly folded return springs for thermostats in irons.

The chemical composition in weight percentages of a steel material, which is very well suited to be subjected to the treatment method according to the present invention is as follows (so-called Sandvik 1RK91 steel):

| | |
|---|---|
| C + N | ≦0.05 |
| Cr | 12.00 |
| Mn | 0.30 |
| Fe | balance |
| Ni | 9.00 |
| Mo | 4.00 |
| Ti | 0.90 |
| Al | 0.30 |
| Si | 0.15 |
| Cu | 2.00 |

EXAMPLE 2

A steel material or product with the same chemical composition as in Example 1 may be produced as a diaphragm plate spring functioning as a return spring in a fluid valve. Depending on the required accuracy of the diaphragm plate spring dimensions, it may be allowed to have so-called rest austenite in the product after quenching 9. In the event that maximum accuracy is required, it is preferred to anneal the solution 7 followed by sensitizing the solution 8 which causes destabilization of the austenite so that the later isothermal martensitic transformation 10 is facilitated. Diaphragm plate springs for many applications use complicated shapes which require strong deformations during forming. Such deformations cause strain induced martensite which has to be reversed into austenite by solution annealing 7. The method of the present invention is well suited to preparing the steel stock for this application.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A method for the manufacture of a steel product comprising the steps of:

(a) subjecting the steel to precipitation hardening in a martensitic structure subsequent to soft annealing;

(b) shaping said steel, followed by solution annealing between a temperature of 1050° C. and 1200° C. and for a time period of from 5 to 30 minutes;

(c) quenching the steel from the solution annealing temperature to a temperature below 500° C. with a quenching rate of at least 5° C. per second, said quenched steel being subjected to an isothermal martensitic transformation; and (d) hardening at a temperature between 450° C. and 550° C. for at least 3 minutes to cause particles to precipitate out from solution into the martensitic structure.

2. The method according to claim 1, wherein the quenched steel is subjected to an isothermal martensitic transformation at a temperature between −30° C. and −50° C. for at least one hour.

3. The method according to claim 1, wherein, between the solution annealing and the quenching of the steel, the steel is subjected to a sensitizing procedure between 850° C. and 950° C. for at least 5 minutes thereby optimizing initiation of the isothermal martensitic transformation.

4. The method according to claim 3, wherein the sensitizing procedure homogeneously nucleates martensite during the isothermal martensitic transformation.

5. The method according to claim 1, wherein the steel comprises chromium (Cr) in a weight percentage between 10% and 14%.

* * * * *